US005487696A

United States Patent [19]

Takemoto et al.

[11] Patent Number: 5,487,696

[45] Date of Patent: Jan. 30, 1996

[54] APPARATUS FOR POLISHING MEDALS FOR GAME MACHINE AND FOR SEPARATING ABRASIVE THEREFROM

[75] Inventors: Takatoshi Takemoto; Masayoshi Yoshikawa, both of Tokyo; Moriyuki Aoyama, Okazaki; Meiji Muramatsu, Yokohama; Kazunari Kawashima, Tokyo, all of Japan

[73] Assignee: Kabushiki Kaisha Ace Denken, Tokyo, Japan

[21] Appl. No.: 119,246

[22] PCT Filed: Oct. 18, 1991

[86] PCT No.: PCT/JP91/01432

§ 371 Date: Nov. 15, 1993

§ 102(e) Date: Nov. 15, 1993

[87] PCT Pub. No.: WO92/17316

PCT Pub. Date: Oct. 15, 1992

[30] Foreign Application Priority Data

Mar. 26, 1991 [JP] Japan ..... 3-061707
Aug. 27, 1991 [JP] Japan ..... 3-215619

[51] Int. Cl.[6] ..... B24B 31/073

[52] U.S. Cl. ..... 451/105; 451/113; 451/66; 451/104; 451/327; 451/74

[58] Field of Search ..... 51/1, 4, 7, 16, 51/17, 18, 20, 21, 26, 163.1, 163.2, 313, 316, 292, 323; 451/74, 559, 66, 113, 103, 104, 105, 107, 108, 114, 326, 327, 32, 35, 54, 60

[56] References Cited

U.S. PATENT DOCUMENTS

| | | | |
|---|---|---|---|
| 2,760,504 | 8/1956 | Spurlin | 134/132 |
| 3,038,186 | 6/1962 | Davy et al. . | |
| 3,965,620 | 6/1976 | Dreher | 51/164 |
| 4,803,811 | 2/1989 | Birkle et al. | 51/7 |
| 4,970,746 | 11/1990 | Brackmann | 15/21.2 |
| 4,987,702 | 1/1991 | Anschutz | 51/164.1 |
| 5,214,883 | 6/1993 | Naumec et al. | 51/163.1 |

FOREIGN PATENT DOCUMENTS

| | | |
|---|---|---|
| 51-72076 | 6/1976 | Japan . |
| 53-91278 | 8/1978 | Japan . |
| 60-43266 | 3/1985 | Japan . |
| 60103676 | 7/1988 | Japan . |
| 1126291 | 8/1989 | Japan . |
| 2231488 | 11/1990 | United Kingdom . |
| 2231804 | 11/1990 | United Kingdom . |

*Primary Examiner*—Bruce M. Kisliuk
*Assistant Examiner*—Eileen P. Morgan
*Attorney, Agent, or Firm*—Lowe, Price, LeBlanc & Becker

[57] ABSTRACT

An apparatus for polishing medals for a game machine, and for separating an abrasive from the medals. An intake port (2) for the medals and the abrasive is provided on the lower end side of a polishing pipe (1) set upright, while a medal delivery port (3) is provided on the upper end side. A rotatable screw element (4) is mounted inside the polishing pipe (1) so as to lift up the medals and the abrasive while stirring them. A separation unit (A) which separates the abrasive from the medals and which feeds the separated abrasive to the intake port (2), is joined to the upper part of the polishing pipe (1).

20 Claims, 10 Drawing Sheets

APPARATUS FOR POLISHING MEDALS FOR GAME MACHINE AND FOR SEPARATING ABRASIVE THEREFROM

TECHNICAL FIELD

The present invention relates to an apparatus for polishing game media, for example, medals for use in a game machine such as a slot machine and for separating an abrasive therefrom, in which the medals are polished while being lifted up together with the abrasive within a polishing machine, and in which the abrasive is there-after separated from the medals and returned to the polishing machine.

BACKGROUND ART

It has heretofore been known that medals for a game machine, such as a slot machine, and an abrasive are mixed and then stirred to polish the medals, and that the abrasive is thereafter separated from the medals and mixed with medals again for reuse.

The prior art, however, has involved the problem that, when the medals and the abrasive are accepted in order to polish the former by the stirring, excessive forces act on the medals to deform them. Another problem has been that a polishing machine increases in height due to requirements of the treatment and its external appearance does not blend well with the surroundings. A further problem has been that, since the abrasive for use is usually made of a plastic material, the abrasive becomes electrostatically charged in the polishing operation and sticks to the medals and is not easily separated therefrom in an abrasive separation unit.

DISCLOSURE OF THE INVENTION

The present invention is intended to solve the problems as mentioned above and to provide an apparatus which can favorably perform the polishing and separating operations. With this object in mind, the apparatus is so constructed that an intake port for accepting the medals and abrasive is provided on a lower end side of a polishing pipe set upright, while a medal delivery port is provided on an upper end side of the polishing pipe, that a rotatable screw element which lifts up the medals and abrasive while stirring them is mounted inside the polishing pipe, and that a separation unit which separates the abrasive from the medals and which permits the separated abrasive to be fed into the intake port is joined to an upper part of the polishing pipe.

Preferably, a flap which prevents the abrasive from splashing can be interposed at that position of the intake port which communicates with a lower part of a return pipe underlying the separation unit. The polishing pipe can be so formed that its lower portion is curved or crooked at an obtuse angle with respect to its upper portion which is vertically erected substantially straight, while a prime mover for driving the rotatable screw element can be disposed at an upper end of the polishing pipe. The intake port can be provided with a clearance between a lower end of the polishing pipe and that of the screw element, and pitches of the screw element can be formed so as to be smaller in a lower portion of the polishing pipe than in an upper portion thereof.

Furthermore, the polishing pipe can be formed into a U-shape or Z-shape as viewed from the side, upper and lower corners of which are round crooked portions, and the separation unit which allows the abrasive to leak down can be mounted on the bottom of the polishing pipe near the upper round crooked portion. The separation unit can be furnished with a channel element for the medals, which communicates with the medal delivery port and which has abrasive passing apertures, and it can also be furnished with a rotatable sweep member or a rotatable screw member over an upper surface of the channel element. This channel element can be formed flat or semicylindrical. The sweep member can be constructed by forming a helical brush member on an outer periphery of a rotatable shaft. A rotatable sweep member having a helical brush member can be mounted on a shaft inside said channel element if the channel element is made cylindrical. The channel element can be rendered free to be driven and rotated. The separation unit can alternatively be furnished with a cylindrical or semicylindrical channel element, which communicates with the medal delivery port and which has abrasive passing apertures, and a rotatable vane element in which vane members are mounted round a shaft in staggered fashion can be disposed inside the separation unit. The separation unit can also be constructed by disposing a slant channel element inside a channel housing which communicates with the medal delivery port as well as a medal delivery portion, and mounting a rotatable sweep member on a shaft over an upper surface of the channel element which can be bent from an upper stream toward a lower stream thereof and the channel housing can have its bottom surface inclined to form a channel toward the intake port. The sweep member is constructed by being arranged in parallel or at right angles with a channel for the medals.

Accordingly, the apparatus can regularly accept the medals from the intake port at the lower end of the polishing pipe while regulating the abrasive by means of the splash preventive flap so as not to be scattered about. In addition, the apparatus can lift up the medals while stirring them together with the abrasive, after having accepted these medals so as to prevent them from being deformed due to excessive forces or from being jammed midway in the interior of the polishing pipe. When the polishing pipe is formed into the U-shape or Z-shape when viewed from the side, it can be formed into a low compact structure so as to harmonize with the surroundings, and the abrasive can be separated away from the bottom of the polishing pipe at and near the upper round crooked portion. Besides, while the medals and the abrasive delivered from the medal delivery port are being moved along the channel element, the abrasive adhering to the medals is separated forcibly and reliably by the sweep member, whereby it can be favorably removed through the abrasive passing apertures. The removed abrasive can be fed into the intake port at the lower end of the polishing pipe so as to be reused.

BEST MODES FOR CARRYING OUT THE INVENTION

Figure 1:
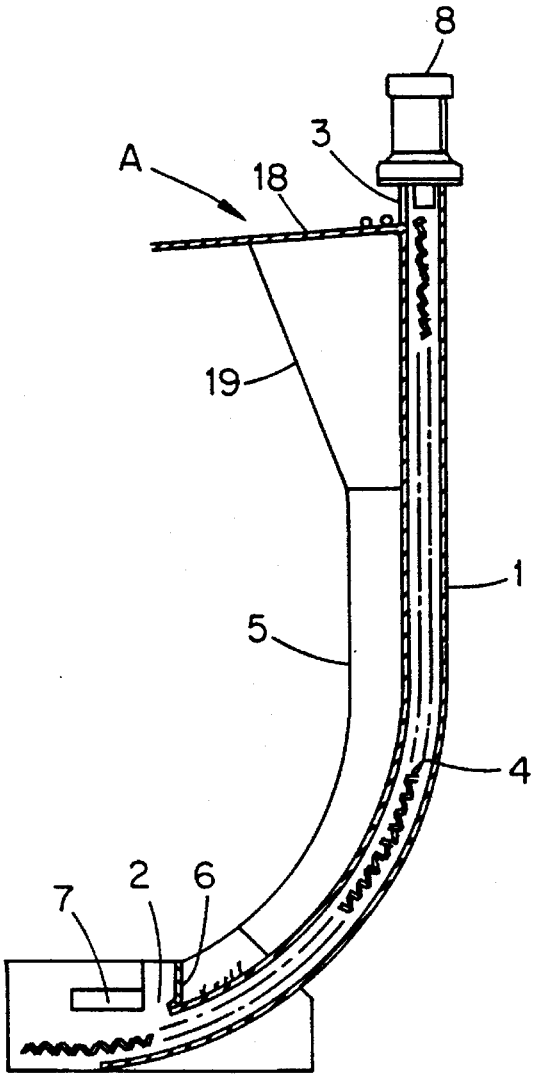
FIG. 1 is a side sectional view showing the essential portions of the first embodiment.
Figure 2:
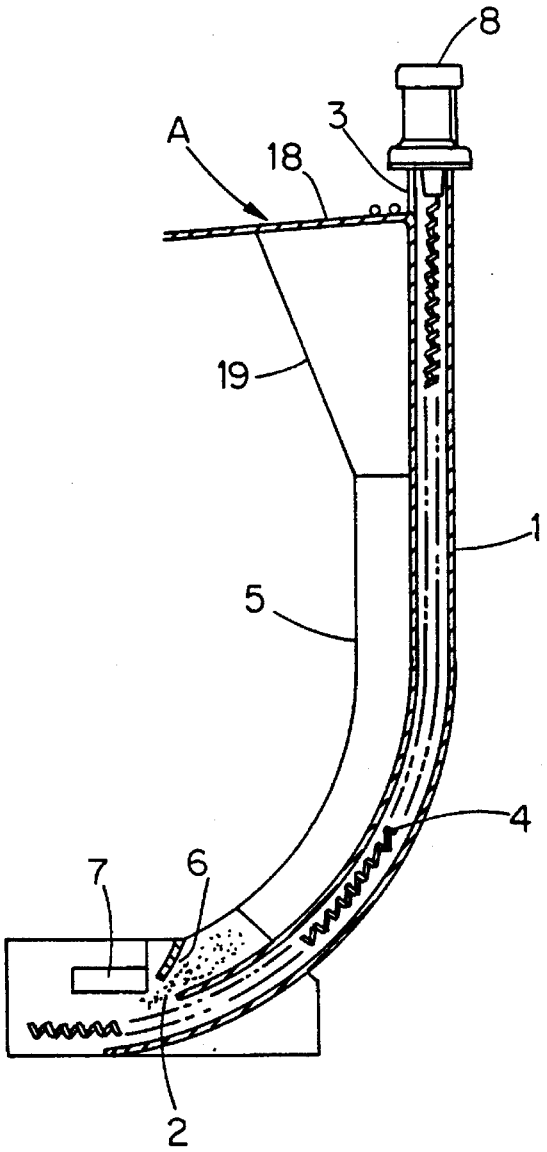
FIG. 2 is a side sectional view showing the operating state of the embodiment in FIG. 1.

FIGS. 1 and 2 illustrate the first embodiment. An intake port which opens upwards facing a supply port 7 for medals is formed at the lower end of the curved lower side of a polishing pipe 1 set upright, while a medal delivery port 3 is formed in the side part of the upper end of the polishing pipe. A screw element which is driven to rotate by a prime mover 8 mounted on the upper end of the polishing pipe 1, is inserted into this polishing pipe 1 and runs the full length thereof. A separation unit A including a screen 18, which can sift off an abrasive while sending out the medals, is disposed outside the medal delivery port 3. Thus, the abrasive leaking down through the screen 18 can be circulated back into the intake port 2 via a recovery hopper 19 as well as a return pipe 5. A splash preventive flap 6 which is formed of a slit deflector made of a rubber sheet and which serves to prevent the abrasive from splashing outwards, is suspended from the upper position of the intake port 2 on the lower end side of the return pipe 5.

In this way, the medals and the abrasive accepted from the intake port 2 are subjected to a polishing operation and are lifted up within the polishing pipe 1 while being stirred by the screw element 4. The medals and the abrasive delivered from the medal delivery port 3 are put on the screen 18, through which the latter leaks down. The abrasive having leaked down is fed from the return pipe 5 into the intake port 2, and is reused. The slit deflector made of the rubber sheet is provided so that, as the abrasive is being introduced below the return pipe, it may be prevented from splashing at the abrasive inlet and scattering out. The abrasive about to rush out collides against the deflector, and is kept in. Thus, the abrasive is smoothly accepted into the intake port.

Figure 3:
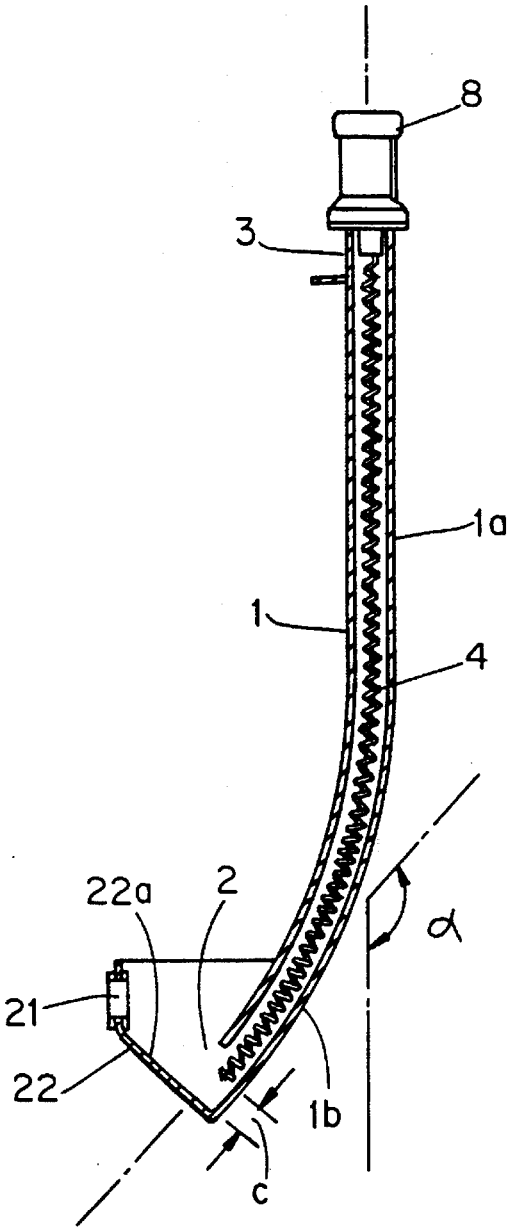
FIG. 3 is a side sectional view showing the essential portions of the second embodiment.
Figure 4:
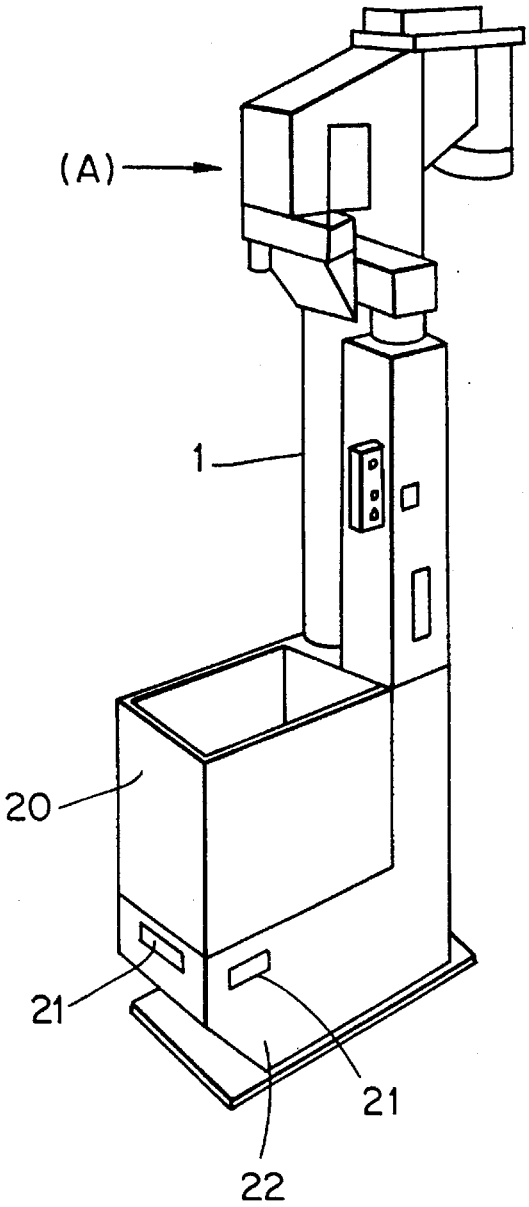
FIG. 4 is a perspective view showing a polishing apparatus furnished with the essential portions in FIG. 3.
Figure 5:
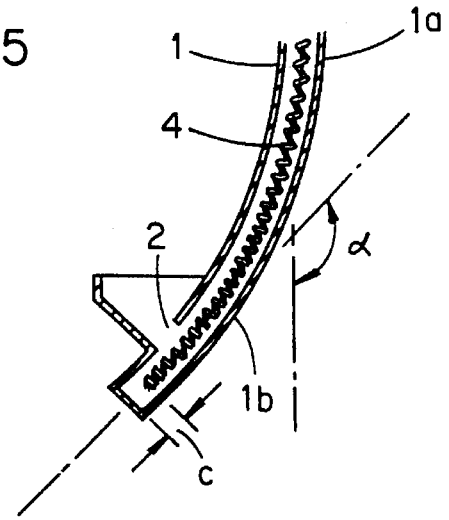
FIG. 5 is a side sectional view showing the essential portions of the third embodiment.

FIGS. 3 and 4 illustrate the second embodiment, which is constructed similarly to the first embodiment as indicated by the same symbols, except to the following: The polishing pipe 1 over which the separation unit A is joined in communication therewith, is so formed that its lower portion 1*b* is curved or crooked at an obtuse angle α with respect to its upper portion 1*a* which is vertically erected and substantially straight. In addition, the pitches of the screw element a, are formed so as to be smaller in the lower portion 1*b* than in the upper portion 1*a*. On the lower end side of the polishing pipe 1, a medal reservoir 22 which is overlaid with an enclosure 20 and which has slots 21 for the medals in its outer periphery is joined in communication with the polishing pipe. The lower end of the screw element 4 is extended into the intake port 2 formed over the lower end side of the polishing pipe 1, so as to define a clearance C between it and the bottom 22*a* of the reservoir 22 serving as the lower end side of the polishing pipe 1. Meanwhile, the third embodiment illustrated in FIG. 5 is so constructed that the bottom 22*a* of the reservoir 22 and the lower end of the screw element 4 are protruded frontwards beyond the inner corresponding position of the intake port 2.

Since, as described above, the polishing pipe 1 is formed so as to have the lower portion 1*b* curved or crooked at the obtuse angle α, the screw element 4 can accept the medals easily and convey them upwards without excessive force so as not to deform them. Moreover, since the clearance C is defined on the lower end side of the screw element 4, the medals are not subjected to excessive force and are not deformed due to the narrowed intervals of the medals on the lower end side of the polishing pipe 1, and they can be smoothly accepted. Furthermore, since the pitches of the screw element 4 are varied, a conveyance force becomes smaller in the lower portion than in the upper portion, and the medals can be smoothly conveyed without being jammed halfway.

Figure 6:
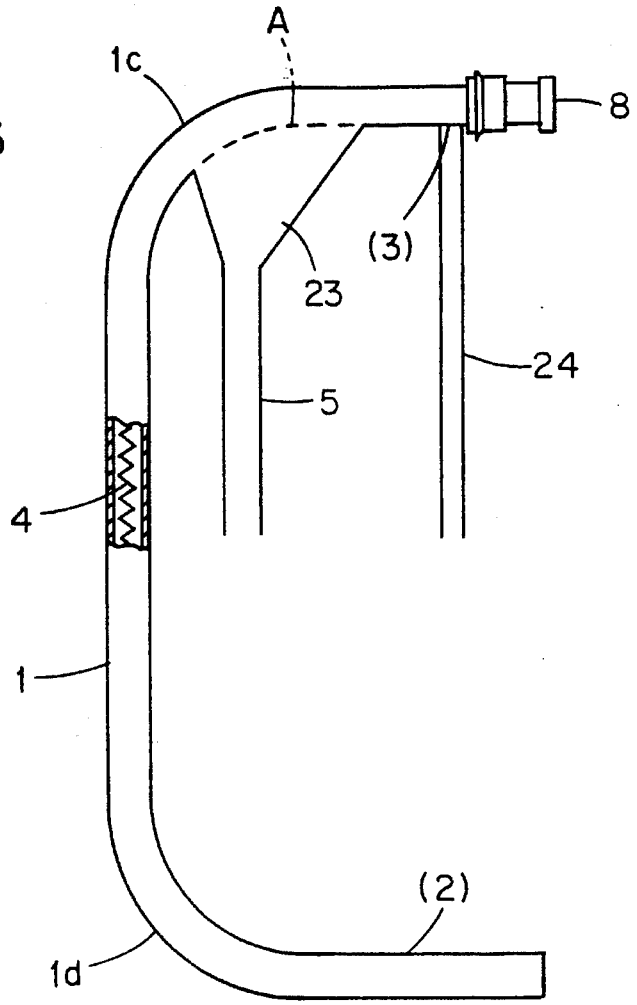
FIG. 6 is a side view showing the essential portions of the fourth embodiment.
Figure 7:
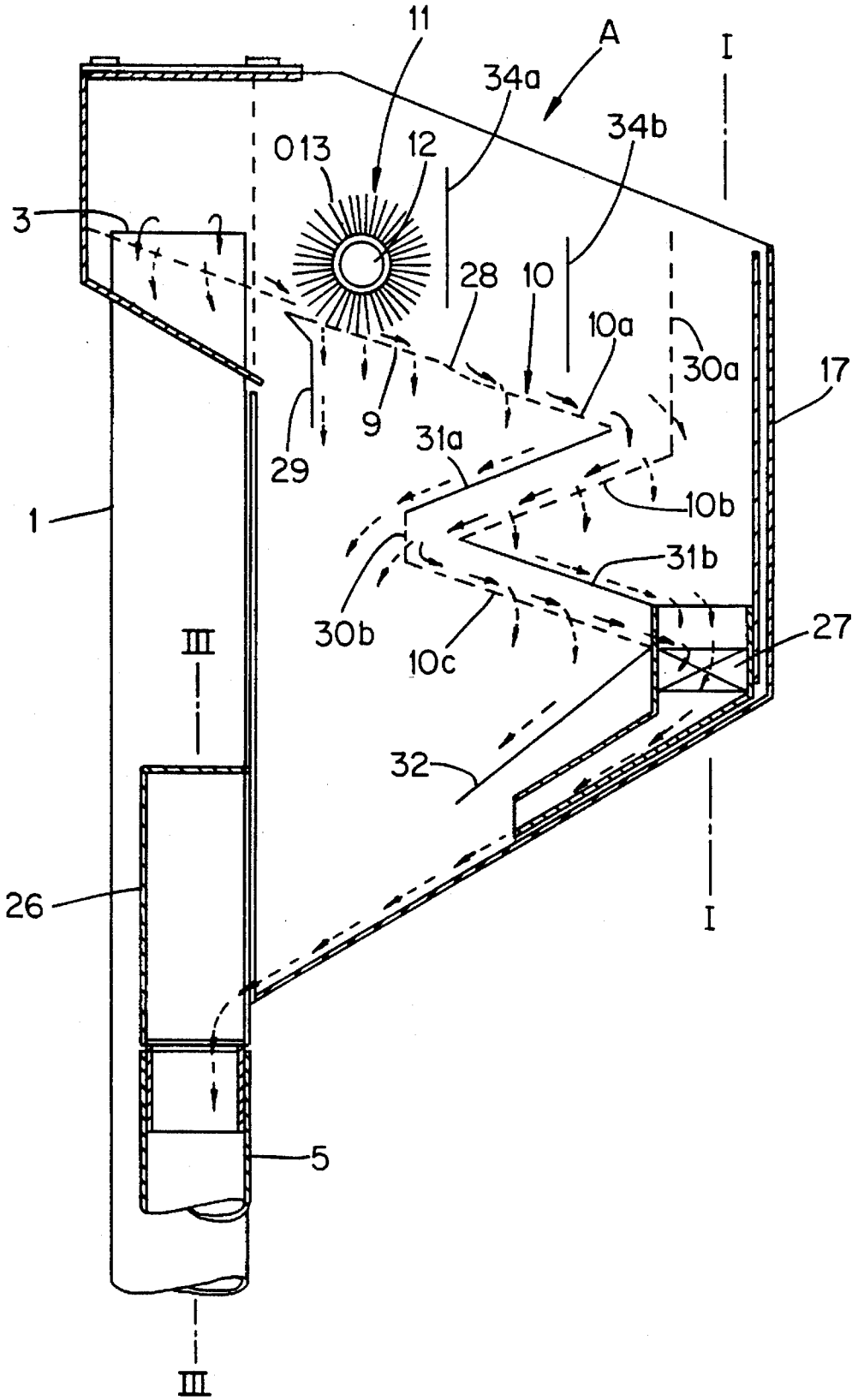
FIG. 7 is a side sectional view showing the essential portions of the fifth embodiment.

FIG. 6 illustrates the fourth embodiment, which is constructed substantially similarly to the preceding embodiments as indicated by the same symbols, except the following: The polishing pipe 1 is formed into a U-shape in a side view, the upper and lower corners of which are rounded portions 1*c*, 1*d*. The prime mover 8 which is horizontal, is attached to the distal end of the upper part of the U-shape polishing pipe 1 which is mounted rotatable sideways through 90°. The filter of the separation unit A allowing the abrasive to leak down is mounted on the lower surface side of the polishing pipe 1 within a lateral range from the round position of the upper round crooked portion 1*c*, and the return pipe 5 is suspended from a recovery hopper 23 underlying the filter. A conveyance pipe 24 is extended from the medal delivery port 3 at the distal end of the part of the polishing pipe 1. Alternatively, this embodiment can be similarly constructed by forming the polishing pipe into a Z-shape in a side view.

Accordingly, the polishing pipe 1 can be installed in the form of a compact structure so as to harmonize with surroundings and to avoid being large in size. The medals and the abrasive can be lifted up while being stirred by the screw element 4, and the abrasive can be separated in the upper part of the polishing pipe 1.

Figure 11:
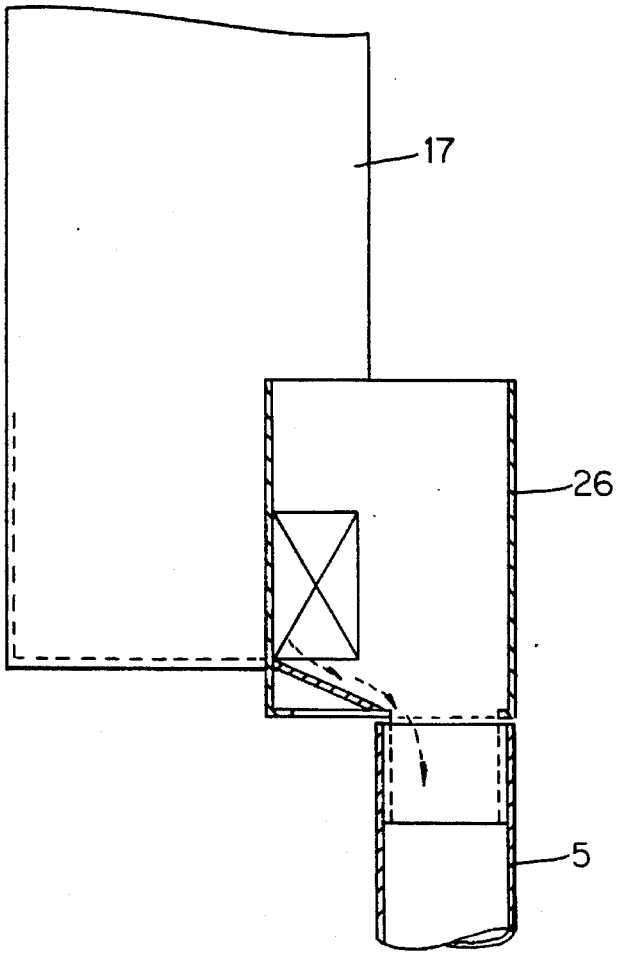
FIG. 11 is a sectional view showing a section taken along line III—III in FIG. 7.

FIGS. 7 thru 11 illustrate the fifth embodiment. In this embodiment, a separation unit A disposed to the side of the upper part of a polishing pipe 1 includes a channel element 10, a sweep member 11, and a channel housing 17 in which the upper part of the polishing pipe 1 is inserted and which communicates with an upper medal delivery port 3 provided at the upper end of the polishing pipe 1. In the channel housing 17, a medal delivery portion 16 is inserted below the medal delivery port 3, and a medal delivery port 25 is joined to the medal delivery portion 16 in communication therewith. The medal delivery portion 16 is a pipe for delivering the medals separated from the abrasive. The channel housing 17 is connected to an abrasive delivery box 26 as shown in FIG. 11, and the abrasive delivery box 26 is communicatingly joined to a return pipe 5 which communicates with an intake port provided at the lower end of the polishing pipe 1. Besides, the channel housing 17 having an inclined bottom receives the channel element 10 therein. The channel element 10 is a plate element which has abrasive passing apertures 9 adapted to pass only the abrasive therethrough, and it is preferably made up of a reticulate plate element. The channel element 10 consists of the first channel section 10*a*, second channel section 10*b*, third channel section 10*c*, fourth channel section 10*d* and fifth channel section 10*e*, which are bent and inclined from the lower stream side of the medal delivery port 3 down to the upper stream side of the medal delivery port 25. The first channel section 10*a* lies at the highest position and slopes downwards from just below the medal delivery port 3 toward an intake port 27, and it is provided at its intermediate part with a stepped portion 28 for shaking off the abrasive. The second channel section 10*b* slopes downwards from just beneath the first channel section 10*a* toward the polishing pipe 1, while the third channel section 10*c* slopes downwards from just below the second channel section 10*b* to the intake port 27. The fourth channel section 10*d* is joined to the intake port 27 in a manner to slope in an orthogonal direction (out of the sheet of the drawing as viewed in FIG. 7) to directions in which the medals flow on the first, second and third channel sections 10*a*, 10*b* and 10*c*. The fifth channel section 10*e* is arranged below the fourth channel section 10*d* in a manner to slope downwards from just beneath this section 10*d* to the medal delivery port 25 of the medal delivery portion 16.

In addition, a guide plate 29 which guides down the abrasive falling through the first channel section 10a is suspended from near the upper most point of this channel section 10*a*. Partition channel sections 30*a*, 30*b* and 30*c* which have abrasive passing apertures similarly to the channel element are vertically mounted at the upper ends of the second, third and fifth channel sections 10*b*, 10*c* and 10*e*, respectively. Channel roof plates 31*a* and 31*b* which cause the abrasive to flow down are mounted aslant over the second and third channel sections 10*b* and 10*c*, respectively. A guide plate 32 is mounted aslant below the lower end of the third channel section 10*c*. Besides, the sweep member 11 is so constructed that a brush member 13 is helically wound on the outer periphery of a shaft 12 which is driven to rotate by a prime mover 33. This sweep member is held in contact with the upper surface of the first channel section 10*a*, and is disposed in the channel housing 17 so as to extend orthogonally to the flowing direction of the medals. Further, slit flexible deflectors 34*a* and 34*b*, and 34*c* which extend orthogonally to the flowing directions of the medals are suspended over the first channel section 10*a* and over the fifth channel section 10*e*, respectively. The deflectors 34*a*, 34*b* and 34*c* are made of a material which is soft to the extent that the abrasive remaining on first channel section 10*a* and the fifth channel section 10*e* can be prevented from splashing downstream, while at the same time, the medals are not hindered from flowing even when a large number of them have flowed down to these deflectors.

Figure 8:
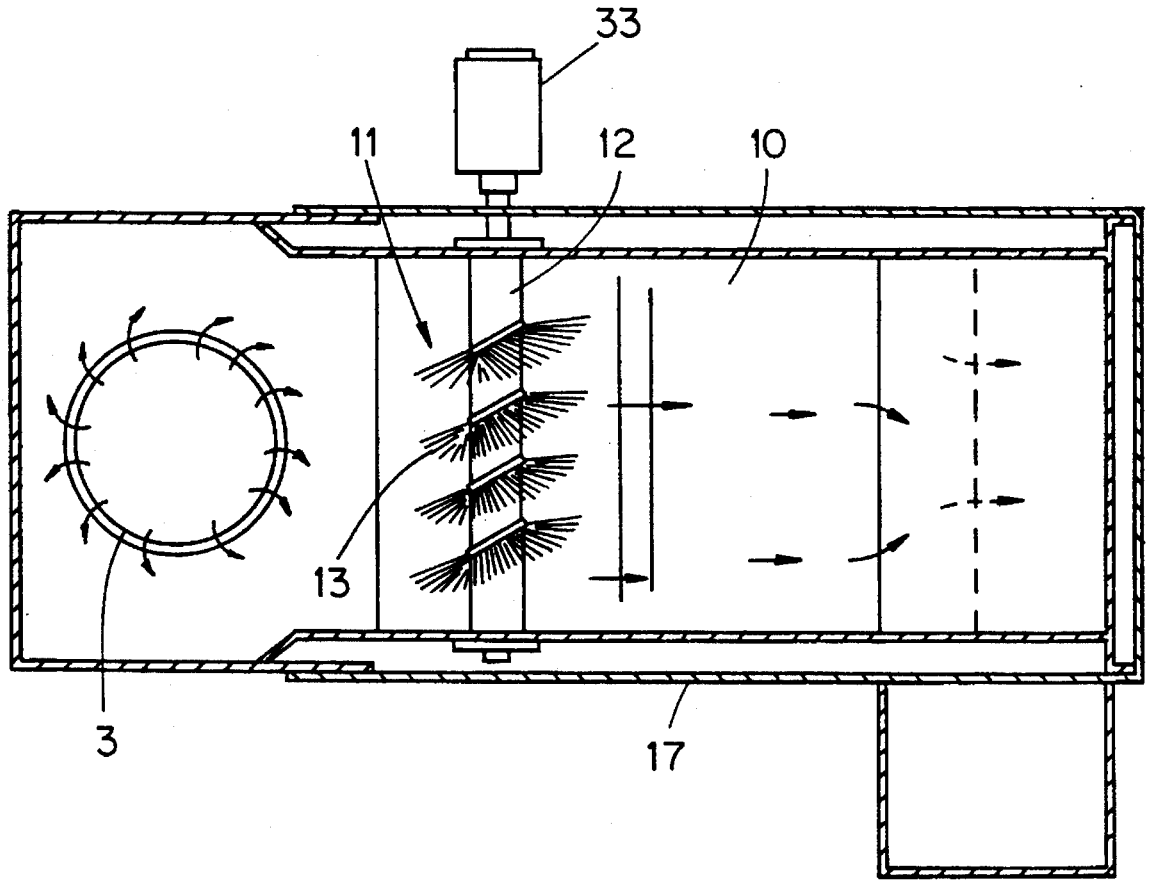
FIG. 8 is a horizontal sectional view showing part of the embodiment in FIG. 7.
Figure 9:
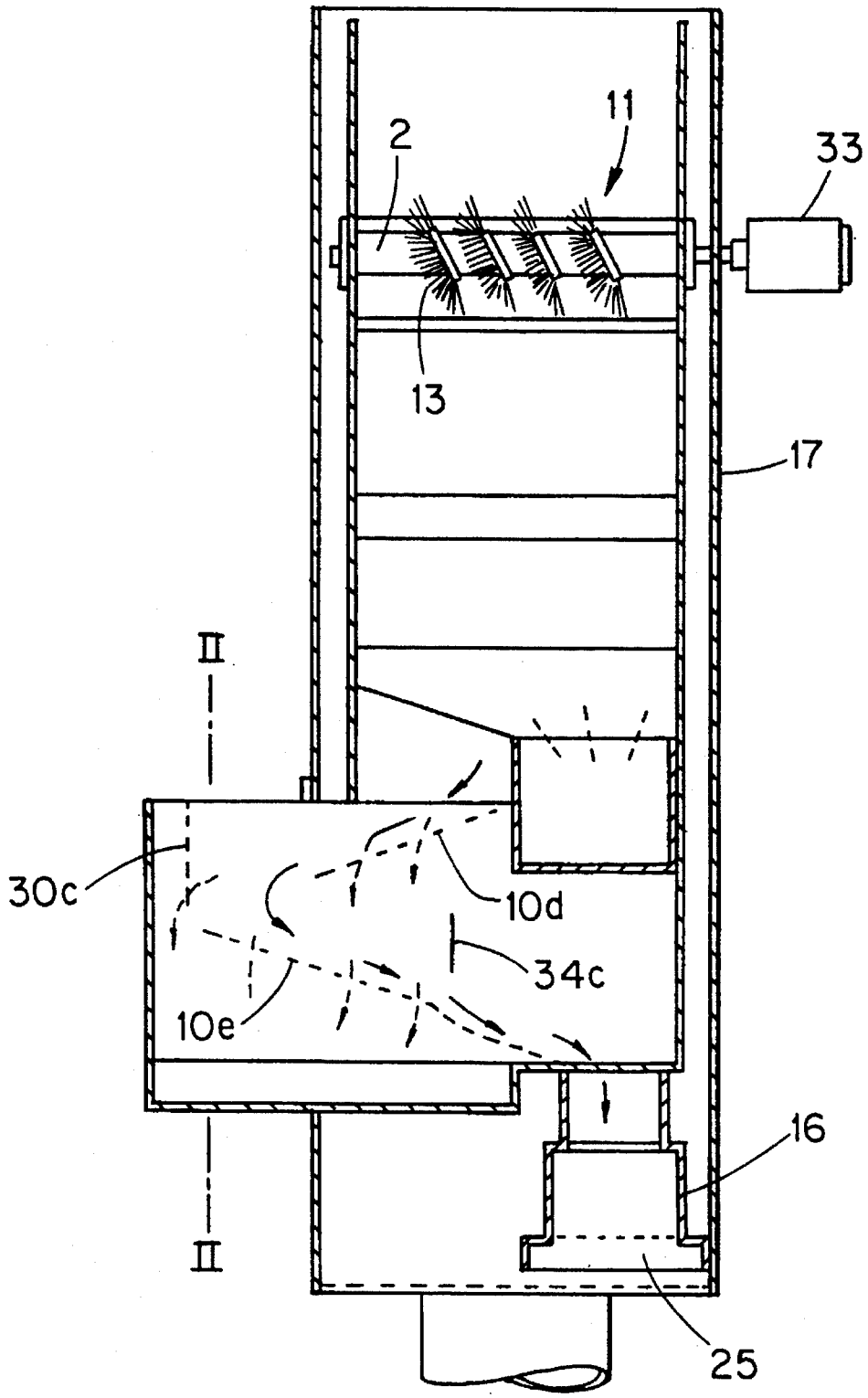
FIG. 9 is a sectional view showing a section taken along line I— I in FIG. 7.
Figure 10:
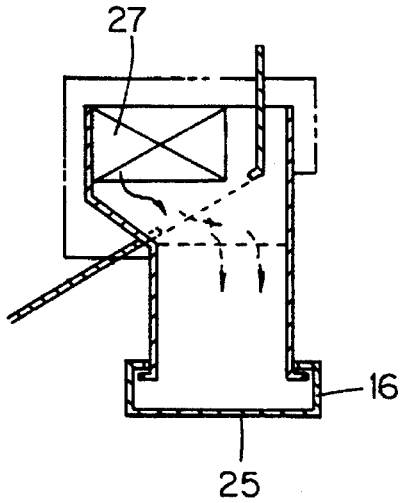
FIG. 10 is a sectional view showing a section taken along line II—II in FIG. 9.

In the construction thus far described, the medals and the abrasive delivered from the medal delivery port 3 at the upper end of the polishing pipe 1 flow as indicated by solid and dotted line arrows in the figures, respectively. Herein, the medals and the abrasive are delivered around the medal delivery port 3 as shown in FIG. 8. Therefore, the medals and the abrasive disperse more than in the case of delivering them in only one direction, so that the abrasive is separated from the medals more effectively. When the medals and the abrasive having dropped onto the first channel section 10*a* slide downstream directly, the abrasive falling through the abrasive passing apertures 9 is guided by the guide plate 29. The medals flowing on the first channel section 10*a* have their surfaces swept by the brush member 13 of the rotated sweep member 11, so that the abrasive stuck to the surfaces of the medals by electrostatic charges etc. is swept off. The abrasive swept off leaks down through the first channel section 10*a*, whereby the medals and the abrasive can be favorably separated. Moreover, the deflectors 34*a* and 34*b* prevent the remaining abrasive on the first channel section 10*a* from splashing downstream. The medals flow from the first channel section 10*a* to the second channel section 10*b* and then to the third channel section 10*c* so as to be accepted from the intake port 27. Further, they flow to the fourth channel section 10*d* and then to the fifth channel section 10*e* so as to be delivered from the medal delivery port 25 at the lowermost position. On the other hand, the abrasive is separated from the medals, not only by the abrasive passing apertures 9 of the first channel section 10*a*, but also by those of each of the partition channel section 30*a*, the second channel section 10*b*, the partition channel section 30*b*, the third channel section 10*c*, the fourth channel section 10*d*, the partition channel section 30*c* and the fifth channel section 10*e*. The first~fifth channel sections 10*a*~10*e* are bent forming a long channel from the uppermost position to the lowermost position. Therefore, even when the distance between the polishing pipe 1 and the medal delivery portion 16 is reduced, a distance for the separating operation can be made long, and the separation between the medals and the abrasive can be satisfactorily performed. Moreover, the abrasive which splashes up from the tokens can be separated by the partition channel sections 30*a*, 30*b* and 30*c*. The deflector 34*c* prevents the remaining abrasive on the fifth channel section 10*e* from splashing downstream. Further, since the abrasive falling onto the channel roof plates 31*a* and 31*b* is directly caused to flow down, it can be prevented from mixing with the medals within the channel again. The abrasive separated from the medals falls to be introduced from the bottom of the channel housing 17 into the abrasive delivery box 26, whereupon it can be returned through the return pipe 5 into the intake port provided in the lower part of the polishing pipe 1. Herein, since the bottom of the channel housing 17 is inclined to form a channel for the abrasive, the abrasive is recovered with ease.

Figure 12:
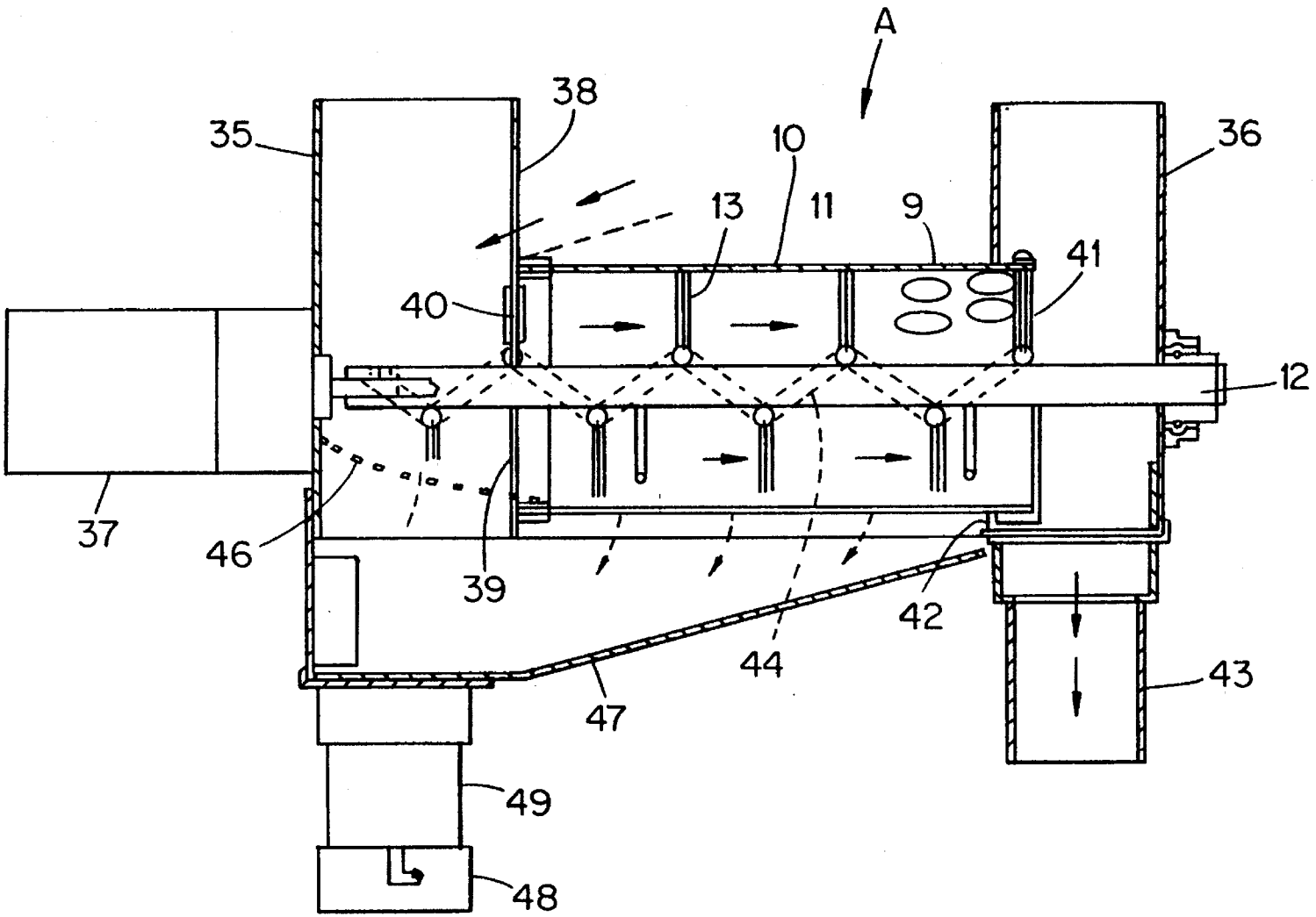
FIG. 12 is a side sectional view showing the essential portions of the sixth embodiment.
Figure 13:
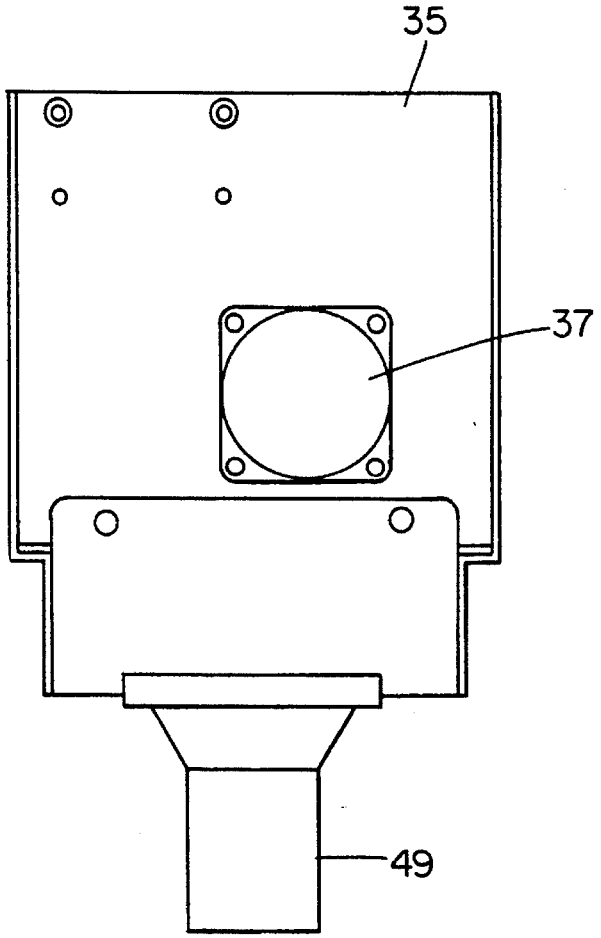
FIG. 13 is a left side view showing part of the embodiment in FIG. 12.
Figure 14:
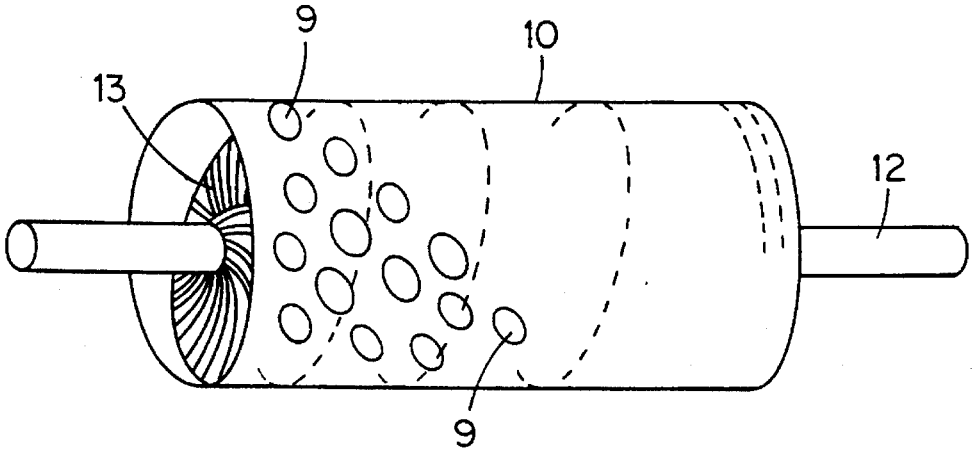
FIG. 14 is a perspective view showing part of the embodiment in FIG. 12.

FIGS. 12 thru 14 illustrate the sixth embodiment, in which a separation unit A includes an upper stream casing 35, a channel element 10, a lower stream casing 36, a prime mover 37 and a sweep member 11. The upper stream casing 35 has a medal intake port 38 and a medal delivery port 39 in its side parts. The channel element 10 is cylindrical, and it is formed with abrasive passing apertures 9 in the whole peripheral surface thereof and has an entrance 40 and an exit 41 on both the end sides thereof. The lower stream casing 36 has an opening 42 in its side part, and a medal delivery portion 43 at its lower part. The upper stream casing 35, the channel element 10 and the lower stream casing 36 are joined in communication. The sweep member 11 is arranged in the channel element 10. It is so constructed that a brush member 13 is radially formed around a helical core 44 disposed along the axis of the channel element 10, that the helical core 44 is wound and fixed round a shaft 12 which is driven to rotate by the prime mover 37, and that the brush member 13 is mounted so as to rotate in contact with the inner peripheral surface of the channel element 10. A wire gauze 46 is spread below the sweep member 11 at the lower part of the upper stream casing 35, an abrasive catcher 47 is mounted aslant under the wire gauze 46 as well as the channel element 10, and an abrasive takeout portion 49 whose lower part is closed by a cap 48 is suspended from the bottom part of the abrasive catcher 47.

Accordingly, when medals and an abrasive delivered from a polishing pipe are fed into the medal intake port 38 of the upper stream casing 35, they flow as indicated by solid and broken line arrows in FIG. 12. After the medals and the abrasive have been accepted into the upper stream casing 35, part of the abrasive is separated by the wire gauze 46, and the medals and the remaining abrasive are sent into the channel element 10 by the sweep member 11. Then, the brush member 13 rotated in contact with the inner peripheral surface of the channel element 10 sweeps off the abrasive through the abrasive passing apertures 9 while stirring the medals and the abrasive together. The abrasive received in the abrasive catcher 47 can be taken out of the abrasive takeout portion 49 by detaching the cap 48. 0n the other hand, the medals sent into the channel element 10 by the sweep member 11 are delivered and dropped from the exit 41 into the lower stream casing 36, and they are thereafter taken out of the medal delivery portion 43.

By the way, the separation apparatus of the sixth embodiment can construct one independent apparatus, and it can also be substituted for the structure of the fifth embodiment as shown in FIG. 11. In this case, the medal intake port 38 of the upper stream casing 35 is connected to the intake port 27 shown in FIGS. 7 and 11, and the medal delivery portion 16 shown in FIGS. 9 and 10 can be replaced with the medal delivery portion 43 of the lower stream casing 36. Accordingly, the abrasive can be separated more reliably without enlarging the separation unit in the sixth embodiment. Alternatively, the channel element 10 can be constructed so as to be driven and rotated about the axis thereof. In this case, the abrasive is returned by a pipe 5 instead of the cap 48.

Figure 15:
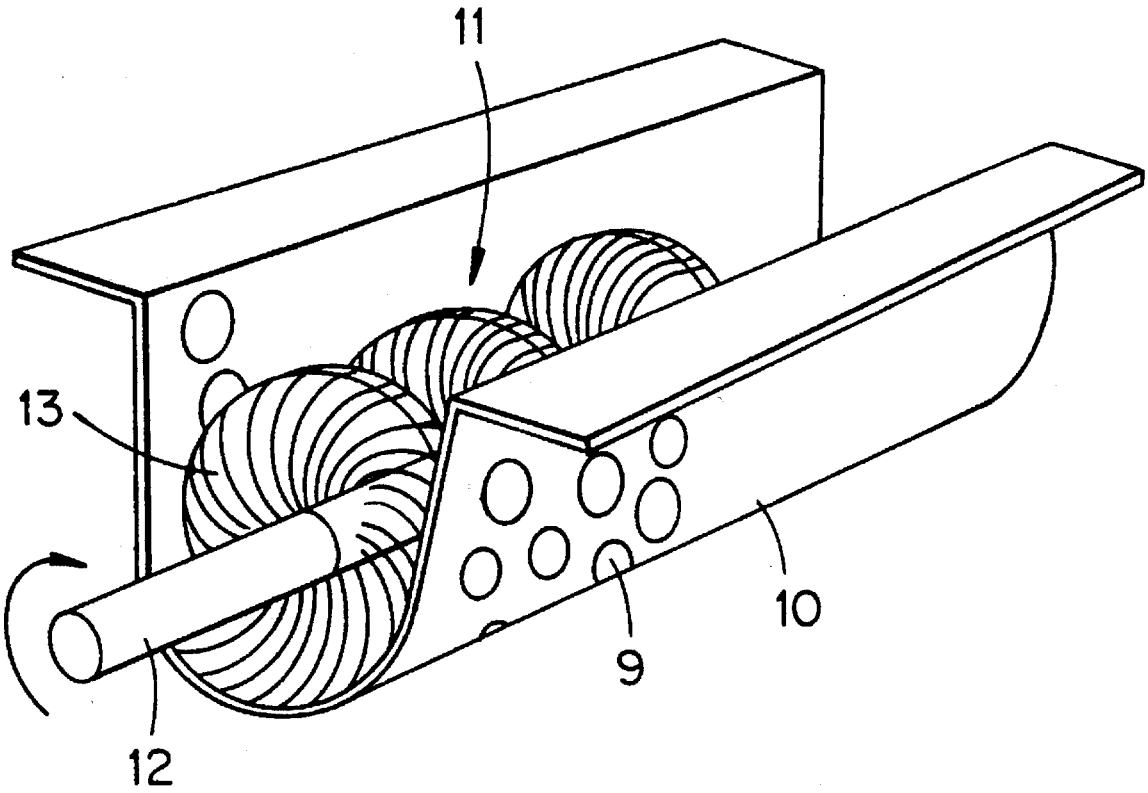
FIG. 15 is a perspective view showing the essential portions of the seventh embodiment.

FIG. 15 illustrates the seventh embodiment. This embodiment is so constructed that a channel element 10 is formed to be semicylindrical and is formed with flange portions 50 on both sides of the upper part thereof, and that a sweep member 11 formed by helically winding a brush member 13 on the outer periphery of a shaft 12 is disposed in the semicylindrical channel element 10 which has abrasive passing apertures 9 over its whole surface. It can operate similarly to the sixth embodiment.

Incidentally, in the sixth or seventh embodiment, the sweep member or the rotary vane member may well be replaced with a helical member. The helical member can be formed by winding, for example, a helical component made of rubber, metal such as sheet metal, or plastic such as duracon round the shaft instead of the brush member in the foregoing embodiment. When the helical member is rotated, the abrasive is expelled while being rotated together with the medals by this helical member. The distance which the medals and the abrasive advance on the channel is lengthened, and the abrasive is sifted off through the abrasive passing apertures at a higher degree. Besides, the channel element can be constructed of, for example, so-called expanded metal, an NC circular-hole plate, punching metal, or a metal gauze. Also, in the case where the helical member is made of rubber, metal, plastic or the like, it may well be rotated together with the channel element 10 unlike the rotation of this helical member only.

Industrial Applicability

In this manner, according to the present invention, medals and an abrasive can be regularly accepted from an intake port 2 at the lower end of a polishing pipe 1 while the abrasive is being regulated by a splash preventive flap 6 so as not to scatter about and to hinder the supply of the medals. In addition, the medals can be favorably accepted so as not to be deformed due to excessive forces or to be jammed in the polishing pipe 1, and they can be lifted up while being stirred with the abrasive. When the polishing pipe 1 is formed into a U-shape or Z-shape in a side view, it can be suitably installed in the form of a low compact structure so as to harmonize with surroundings, and besides, the abrasive can be favorably separated through a bottom surface at and near an upper rounded portion 1*c*. Moreover, while the medals and the abrasive delivered from a medal delivery port 3 are kept flowing along a channel element 10, the abrasive adhering to the medals can be separated forcibly and reliably by a sweep member 11, a rotary vane member 14 or a helical member, to thereby be favorably removed through abrasive passing apertures 9. It is also possible to feed the removed abrasive into the intake port 2 at the lower end of the polishing pipe 1 for the purpose of reuse. Thus, an apparatus which polishes the medals and separates the abrasive therefrom reliably and favorably is provided with a simple construction.

We claim:

1. An apparatus for polishing medals for a game machine and for separating an abrasive from the medals, including: a polishing pipe 1 which is disposed upright for lifting a mixture of the medals and the abrasive supplied thereto while stirring the mixture so as to polish the medals; and a separation unit A which is disposed at an upper portion of said polishing pipe 1 for separating said abrasive from the mixture of said medals and abrasive delivered from said polishing pipe 1, and re-feeding said abrasive into said polishing pipe 1; said polishing pipe 1 having an intake port 2 for receiving said medals and said abrasive supplied thereto, at a lower portion side thereof, a medal delivery port 3 at an upper end portion thereof, and a rotatable screw element 4 which lifts up said medals and said abrasive while stirring them together, which is characterized in:

that said separation unit A is provided with a return pipe 5 for returning the separated abrasive to said intake port; and that said return pipe 5 is provided with a flap which is movable toward said intake port 2 by a weight of said abrasive, at a lower portion thereof which communicates with said intake port 2.

2. An apparatus for polishing medals for a game machine and for separating an abrasive from the medals as defined in claim 1, wherein said polishing pipe is so formed that its lower portion is disposed on a curve which is at an obtuse angle $\alpha$ with respect to its upper portion which is vertically erected and substantially straight, and has, at an upper end thereof, a prime mover for driving said screw element.

3. An apparatus for polishing medals for a game machine and for separating an abrasive from the medals as defined in claim 2, wherein said polishing pipe 1 holds, inside thereof, said screw element 4 with a clearance C between a lower end of the polishing pipe 1 and s lower end of said screw element 4.

4. An apparatus for polishing medals for a game machine and for separating an abrasive from the medals as defined in claim 3, wherein pitches of said screw element 4 are so selected as to be smaller at a lower portion 1*b* of said polishing pipe 1 than at an upper portion 1*a* thereof.

5. An apparatus for polishing medals for a game machine and for separating an abrasive from the medals, including: a polishing pipe 1 which is disposed upright for lifting a mixture of the medals and the abrasive supplied thereto while stirring the mixture so as to polish the medals; and a separation unit A which is disposed at an upper portion of said polishing pipe 1 for separating said abrasive from the mixture of said medals and abrasive delivered from said polishing pipe 1, and re-feeding said abrasive into said polishing pipe 1; said polishing pipe 1 having an intake port 2 for receiving said medals and said abrasive supplied thereto, at a lower portion side thereof, a medal delivery port 3 at an upper end portion thereof, and a rotatable screw element 4 which lifts up said medals and said abrasive while stirring them together, which is characterized in:

that said polishing pipe 1 has a bent configuration including upper and lower corners, said corners being formed to be rounded; and that said separation unit A is mounted on a bottom of said polishing pipe 1 in the vicinity of the upper corner 1*c* to allow said abrasive to leak down.

6. An apparatus for polishing medals for a game machine and for separating an abrasive from the medals as defined in claim 5, wherein said polishing pipe 1 is formed in one of a Channel-shape and a Z-shape in a side view.

7. An apparatus for polishing medals for a game machine and for separating an abrasive from the medals, including: a polishing pipe 1 which is disposed upright for lifting a mixture of the medals and the abrasive supplied thereto while stirring the mixture so as to polish the medals; and a separation unit A which is disposed at an upper portion of said polishing pipe 1 for separating said abrasive from the mixture of said medals and abrasive delivered from said polishing pipe 1, and re-feeding said abrasive into said polishing pipe 1; said polishing pipe 1 having an intake port 2 for receiving said medals and said abrasive supplied thereto, at a lower portion side thereof, a medal delivery port 3 at an upper end portion thereof, and a rotatable screw element 4 which lifts up said medals and said abrasive while stirring them together, which is characterized in:

that said separation unit A is furnished with:

a channel element 10 disposed so as to communicate with said medal delivery port 3 and having abrasive passing apertures 9 for allowing only abrasive to pass therethrough, along a medal channel; and a sweep member 11 disposed over any portion along said medal channel of said channel element 10 for sweeping said medals flowing therein;

said sweep member 11 comprising a rotatable shaft 12, a brush member 13 on an outer periphery of said rotatable shaft 12, and a prime mover 33 which drives said shaft 12 to rotate;

said prime mover 33 driving said shaft 12 to rotate for rotating said brush member 13 to sweep said medals in said channel element 10.

8. An apparatus for polishing medals for a game machine and for separating an abrasive from the medals as defined in claim 7, characterized by that said brush member 13 is disposed helically on an outer periphery of a shaft.

9. An apparatus for polishing medals for a game machine and for separating an abrasive from the medals as defined in claim 8, characterized by:

that said channel element 10 is constructed by disposing a panel comprising abrasive passing apertures 9 with an inclination along at least one slope; and that said rotatable shaft of said sweep member is disposed so as to make its rotation axis cross a direction of flow of medals in a channel element.

10. An apparatus for polishing medals for a game machine and for separating an abrasive from the medals as defined in claim 9, wherein:

said sweep member 11 is disposed at upper stream of said channel element 10; and said separation unit A further comprises at least one splash preventive member to prevent abrasive from splashing, over a part of said channel element 10 which is lower stream of the part where said sweep member 11 is disposed.

11. An apparatus for polishing medals for a game machine and for separating an abrasive from the medals as defined in claim 10, wherein:

said channel element 10 comprises a bending structure which has at least one turning point from upper stream through lower stream.

12. An apparatus for polishing medals for a game machine and for separating an abrasive from the medals as defined in claim 8, characterized by:

that said channel element 10 comprises a part which is formed to be semi-cylindrical and to have abrasive passing apertures 9 on its circumferential surface; and that said rotatable shaft of said sweep member is disposed so as to have its rotation axis along a cylindrical axis of the semi-cylindrical part of said channel element.

13. An apparatus for polishing medals for a game machine and for separating an abrasive from the medals as defined in claim 8, characterized by:

that said channel element 10 has a cylindrical form comprising abrasive passing apertures 9 on its circumferential surface; and that said rotatable shaft of said sweep member is disposed so as to have its rotation axis along a cylindrical axis of said channel element.

14. An apparatus for polishing medals for a game machine and for separating an abrasive from the medals as defined in claim 13, wherein said channel element 10 comprises a structure in which it is freely driven to rotate.

15. An apparatus for polishing medals for a game machine and for separating an abrasive from the medals, including: a polishing pipe which is disposed upright for lifting a mixture of the medals and the abrasive supplied thereto while stirring the mixture so as to polish the medals; and a separation unit which is disposed at an upper portion of said polishing pipe for separating said abrasive from the mixture of said medals and abrasive delivered from said polishing pipe, and re-feeding said abrasive into said polishing pipe; said polishing pipe having an intake port for receiving said medals and said abrasive supplied thereto, at a lower portion side thereof, a medal delivery port at an upper end portion thereof, and a rotatable screw element which lifts up said medals and said abrasive while stirring them together, which is characterized in:

that said separation unit is furnished with:

a channel element for said medals which has abrasive passing apertures, that allow only abrasive to pass, disposed along a medal channel, and one end of which communicates with said medal delivery port and is disposed with an inclination;

a sweep member which is disposed over any portion along said medal channel of said channel element, and which sweeps said medals flowing therein, said sweep member is disposed at upper stream of said channel element;

a channel housing which houses said channel element 10 and said sweep member 11; and at least one splash preventive member to prevent abrasive from splashing, over a part of said channel element which is lower stream of the part where said sweep member is disposed.

16. An apparatus for polishing medals for a game machine and for separating an abrasive from the medals as defined in claim 15, wherein:

said channel element 10 comprises a bending structure which has at least one turning point from upper stream through lower stream.

17. An apparatus for separating an abrasive from medals used in a game machine, characterized by its structure wherein:

said apparatus for separating an abrasive is attached to a medal delivery port of a polishing pipe having means to lift said medals and said abrasive, said means stirring said metals and abrasive while lifting to polish; and said abrasive is separated from said medals and is discharged from said polishing pipe through a screen, and returned into said polishing pipe through a return pipe;

said apparatus for separating an abrasive comprising:

a channel element disposed so as to communicate with said medal delivery port and having abrasive passing apertures for allowing only abrasive to pass therethrough, along a medal channel; and a sweep member disposed over any portion along said medal channel of said channel element for sweeping said medals flowing therein;

said sweep member comprising a rotatable shaft, a brush member on an outer periphery of said rotatable shaft, and a prime mover which drives said shaft to rotate;

said prime mover driving said shaft to rotate for rotating said brush member to sweep said medals in said channel element.

18. An apparatus for separating an abrasive from medals for a game machine as defined in claim 17, characterized by:

that said brush member is disposed helically on an outer periphery of a shaft.

19. An apparatus for separating an abrasive from medals for a game machine as defined in claim 18, characterized by:

that said channel element is constructed by disposing a panel comprising abrasive passing apertures with an inclination along at least one slope; and that said rotatable shaft of said sweep member is disposed so as to make its rotation axis cross a direction of flow of medals in the channel element.

20. An apparatus for separating an abrasive from medals for a game machine as defined in claim 19, wherein:

said sweep member is disposed upper stream of said channel element; and further comprising:

at least one splash preventive member to prevent abrasive from splashing, which is disposed over a part of said channel element which is lower stream of the part where said sweep member is disposed.

* * * * *